US005991986A

United States Patent [19]

Canna et al.

[11] Patent Number: 5,991,986

[45] Date of Patent: Nov. 30, 1999

[54] BUCKLE HAVING MISTHREADING PREVENTOR

[75] Inventors: John S. Canna, Orchard Park; Kenneth VonFelten, Marietta, both of N.Y.

[73] Assignee: Mattel, Inc., El Segundo, Calif.

[21] Appl. No.: 09/143,543

[22] Filed: Aug. 28, 1998

[51] Int. Cl.[6] ..... A44B 11/00

[52] U.S. Cl. ..... 24/625; 24/197; 24/200

[58] Field of Search ..... 24/625, 634, 642, 24/615, 196, 197, 200, 194, 182, 164

[56] References Cited

U.S. PATENT DOCUMENTS

| | | | |
|---|---|---|---|
| 2,573,527 | 10/1951 | White | 24/196 |
| 4,171,555 | 10/1979 | Bakker et al. | 24/200 |
| 4,296,531 | 10/1981 | Bengtsson | 24/200 |
| 4,677,711 | 7/1987 | Anscher | 24/200 |
| 4,864,700 | 9/1989 | Kasai | 24/573 |
| 4,866,819 | 9/1989 | Kasai | 24/614 |
| 5,222,278 | 6/1993 | Ball et al. | 24/196 |
| 5,243,741 | 9/1993 | Fudaki et al. | 24/197 |
| 5,263,234 | 11/1993 | Fudaki | 24/662 |
| 5,307,542 | 5/1994 | Murai | 24/197 |
| 5,309,610 | 5/1994 | le Gal | 24/625 |
| 5,331,726 | 7/1994 | Suh | 24/625 |
| 5,526,556 | 6/1996 | Czank | 24/637 |
| 5,588,189 | 12/1996 | Gorman et al. | 24/632 |
| 5,606,783 | 3/1997 | Gillis et al. | 24/632 |
| 5,651,166 | 7/1997 | Lundstedt | 24/200 |

*Primary Examiner*—Victor N. Sakran
*Attorney, Agent, or Firm*—Morgan, Lewis & Bockius LLP

[57] ABSTRACT

A buckle is shown having two side members that define an upper face and a lower face, with at least three stationary transverse members disposed between and connecting facing inner surfaces of the side members. The three transverse members are substantially parallel to each other and define therebetween belt passageways through which a belt can be threaded and looped around a center one of the transverse members to adjustably secure the belt relative to the buckle. A flange protrudes into one of the belt passageways from substantially the entire length of the center transverse member. The flange is angled toward a first end of the belt passageway, and the distal end of the flange is spaced from the adjacent transverse member by an amount that is slightly larger than the thickness of the belt to be threaded through the belt passageway. The flange prevents threading of a belt through the belt passageway from the first end of the passageway.

17 Claims, 3 Drawing Sheets

BUCKLE HAVING MISTHREADING PREVENTOR

FIELD OF THE INVENTION

This invention relates generally to belt fasteners, and more particularly to a buckle that adjustably secures a belt.

RELATED ART

Adjustable belt fasteners have many uses in leisure, camping, sports, and safety products, where it is desired that a strap or belt be adjustably secured. Examples include seat belts for automobiles, shoulder straps for backpacks or luggage, and the adjustable straps for life jackets. Conventional belt fasteners often require that a belt or strap be threaded through the fastener in the proper direction in order to ensure that the belt or strap is held in the proper position without slipping by the fastener. When the belt or strap is threaded through such a conventional fastener in the wrong direction, a force on the belt in a direction away from the fastener will cause the belt to slip back through the fastener, thereby changing the adjusted length of the belt. This is an undesirable situation. Conventional fasteners often allow for improper threading of the belt or webbing material through the fastener unbeknownst to the user.

Other conventional strap fasteners require the strap to be formed in complicated loops, which prevents any simple or rapid adjustment of the length of the strap to be made. Some conventional buckles also include parts that are movable in relation to each other, but such construction causes increased production and attachment costs, and is furthermore unsuitable when heavy loads may occur.

Buckles or webbing fasteners generally include a frame with several transverse members about which one or more end portions of webbing are secured. Typically a first end portion of webbing is looped around one of the transverse members and secured to itself (such as by stitching or other suitable means known in the art), and a second end portion of the webbing is adjustably threaded between a combination of two or more transverse members that frictionally engage and prevent slippage of the second end portion of webbing. A number of conventional strap fasteners include variations on a sliding transverse bar that moves in guide slots along inner side portions of the buckle frame and is engageable with the webbing, wherein increased tension on the webbing tends to increase friction with the slideable transverse member. A disadvantage with separate parts such as the slideable transverse bar is that additional manufacturing or fabrication steps are required, with a resultant increase in costs and assembly time.

SUMMARY OF THE INVENTION

An adjustable belt fastener according to an aspect of the present invention includes a body having two opposing, internal surfaces that are fixed relative to each other and that define a passageway therebetween. A first one of the two opposing surfaces includes a portion that projects into the passageway such that an angle between the first opposing surface and a surface of the portion facing a first end of the passageway is greater than an angle between the first opposing surface and a surface of the portion facing the opposite, second end of the passageway. The surface of the projection having a greater angle relative to the first opposing surface provides more of a guide to direct a webbing member into the passageway than the surface of the projection having a smaller angle relative to the first opposing surface. A greater angle between the surface of the projection and the first opposing surface directs a larger portion of any axial load exerted on the webbing toward the passageway, thereby making it easier to thread the webbing member into the passageway from the first end toward the second end. The projection into the passageway can also be a relatively flexible member angled toward the desired exit end of the passageway. Such a flexible member will cam out of the way of the webbing material if contacted by the webbing material as it is fed into the passageway from the entrance end. The flexible member will, however, interfere with passage of the webbing material through the passageway from the exit end toward the entrance end if contacted by the webbing.

The body can be formed with two side members that define an upper face and a lower face. First and second transverse strut members are disposed substantially parallel to each other between and connecting facing inner surfaces of the side members. A belt or strap passageway is defined between the side members and the first and second transverse strut members. A third transverse strut member can also be disposed substantially parallel to the first and second strut members, between and connecting the facing inner surfaces at an end of the belt fastener such that a second belt or strap passageway is defined between the first strut member and the third strut member. A belt can be threaded through the second belt passageway between the first and third strut members and looped around the first strut member before passing through the first belt passageway between the first and second strut members. The adjustable belt fastener can be either a male or female member that is detachably connectable with an associated mating member having another strap connected thereto. Alternatively, a portion of the adjustable belt fastener could have webbing fixedly connected thereto, with a second portion of the fastener forming an adjustable portion in accordance with the above-discussed features.

In one embodiment according to the invention, the first transverse strut member about which the belt is looped is provided with a flange that protrudes along substantially the entire length of the first strut member between the facing inner surfaces of the side members of the fastener. The flange protrudes into the first belt passageway at an acute angle to the first transverse strut member so as to be angled in the first belt passageway toward a belt exit. A first surface of the flange faces the belt exit of the first belt passageway and is disposed at an acute angle with respect to the outer peripheral surface of the first transverse strut member. A second surface of the flange opposite the first surface faces a belt entrance of the first belt passageway and is disposed at an obtuse angle with respect to the outer peripheral surface of the first transverse strut member.

The distal end of the flange protruding into the first belt passageway toward the belt exit prevents misthreading of the belt through the buckle by interfering with the end of any belt that one attempts to thread through the first belt passageway from the belt exit toward the belt entrance. The distance between the distal end of the flange protruding into the first belt passageway and the second transverse strut member is predetermined at an amount that is just slightly larger than the thickness of the belt to be threaded through the buckle. A properly threaded belt is passed through the second belt passageway between the first transverse strut member and the third transverse strut member, and then is looped around the first transverse strut member and passed through the first belt passageway from the belt entrance toward the belt exit. The second transverse strut member includes a relatively sharp edge adjacent the exit end of the first belt passageway. The adjustable end of the belt protruding from the exit end of the first belt passageway is bent across the relatively sharp edge of the second strut member and trapped between the edge and the remaining portion of the belt to be frictionally secured against movement when the remaining portion of the belt is under tension.

DESCRIPTION OF THE PREFERRED EMBODIMENT

Figure 1:
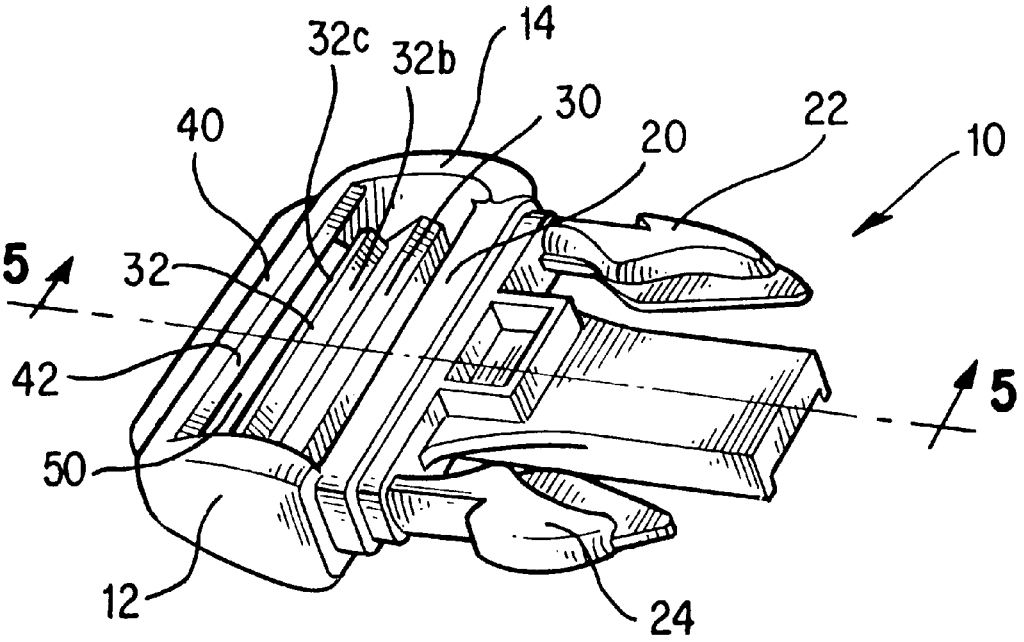
FIG. 1 is a perspective view from an upper side of a buckle according to the invention.
Figure 2:
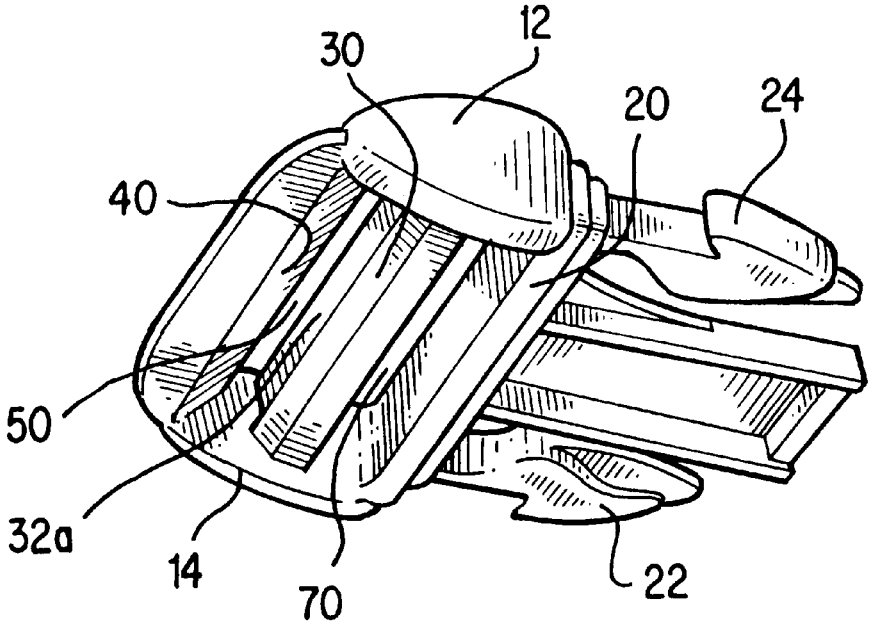
FIG. 2 is a perspective view from a lower side of the buckle in FIG. 1.
Figure 3:
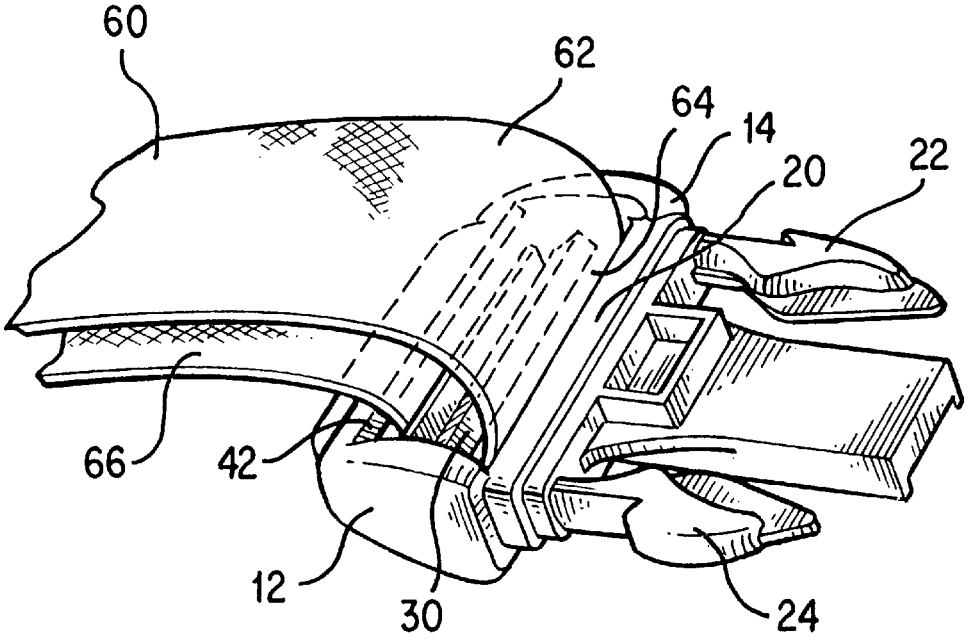
FIG. 3 is a perspective view from an upper side of the buckle in FIG. 1, showing a strap adjustably secured to one end of the buckle.
Figure 4:
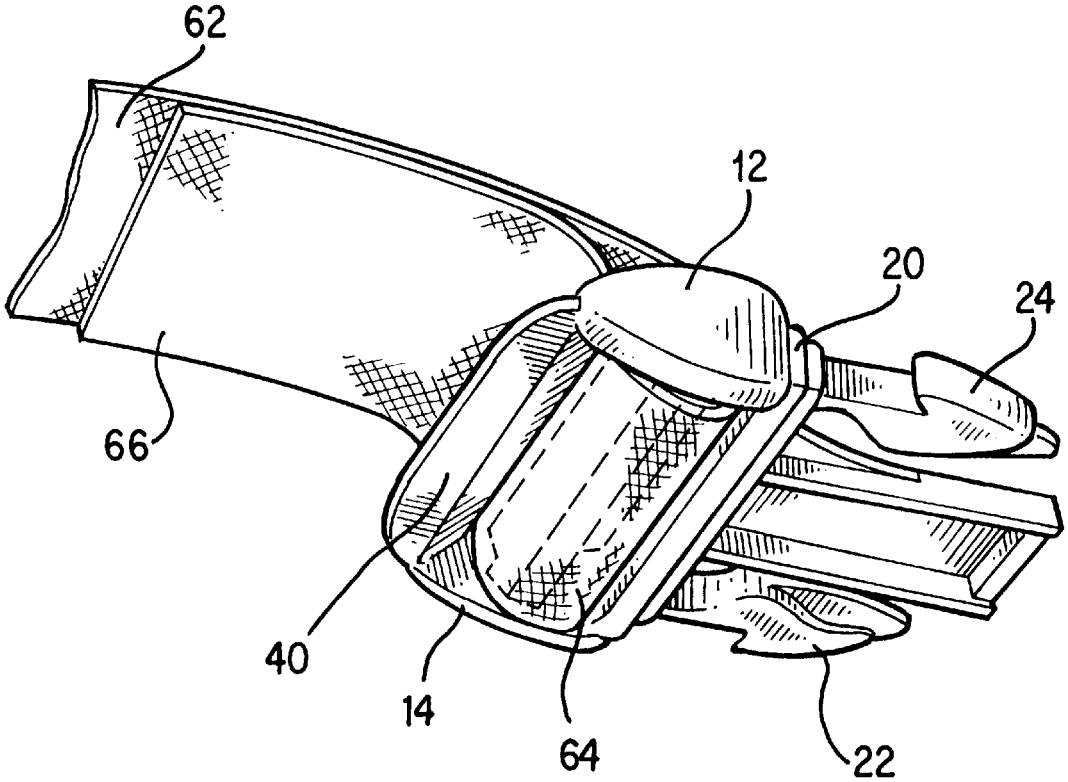
FIG. 4 is a perspective view from a lower side of the buckle of FIG. 1, showing a strap adjustably secured to one end of the buckle.
Figure 5:
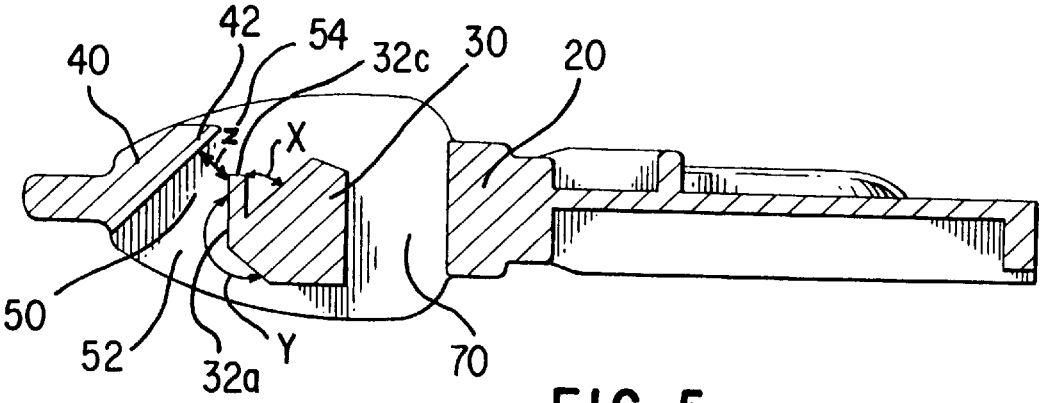
FIG. 5 is a cross-section of the buckle of FIG. 1 along line 5—5 of FIG. 1.

A buckle or webbing fastener embodying the principles of the invention is illustrated in FIGS. 1 and 2. FIGS. 3 and 4 show the same buckle type fastener with a strap adjustably secured to the buckle. Buckle 10 has two side members 12 and 14 that define the sides of the buckle and also the top face 16 and bottom face 18. Side members 12 and 14 are symmetrical with respect to each other about a longitudinal plane 15 that passes through the middle of the buckle. Extending between and connecting facing inner surfaces of side members 12 and 14 are a first transverse strut member 30, a second transverse strut member 40, and a third transverse strut member 20 at the connecting end of the buckle 10. The buckle shown in the figures is a male member having two prongs 22 and 24 at the connecting end 20. Alternative embodiments of the buckle could be formed with the connecting end 20 having receptacles for receiving prongs of a mating fastener such that the buckle 10 forms a female member. Additionally, the invention could be applied to a webbing fastener having one portion with webbing fixedly connected to the fastener, and a second portion for adjustable connection of either a second piece of webbing or the opposite end of the webbing that is fixedly connected to the fastener.

Figure 6:
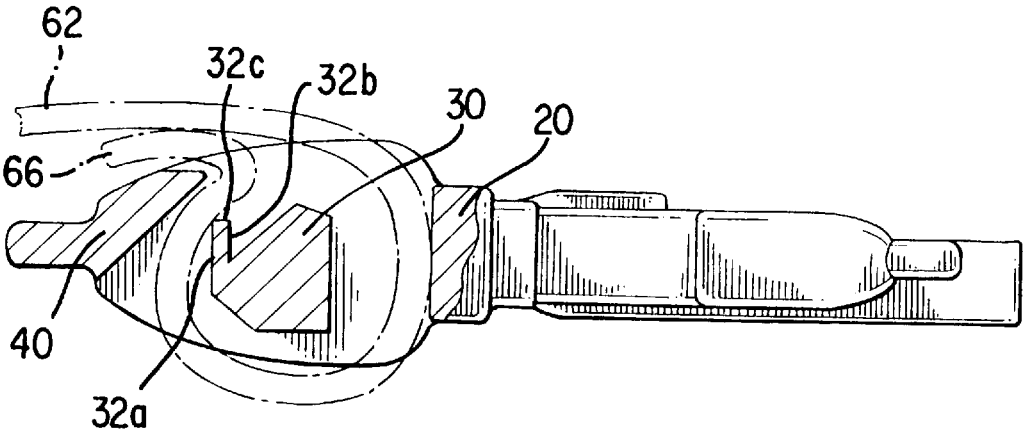
FIG. 6 is a cross-section of the buckle of FIG. 1, similar to FIG. 5 and illustrating a proper threading direction of a belt through the buckle.

As shown in FIG. 6 a belt or strap 60 can be threaded through the buckle 10 from the top face 16 through a second belt passageway 70 between the first transverse strut member 30 and the third transverse strut member 20 before intersecting the bottom face 18 of the buckle. The belt 60 is then looped around the first transverse strut member 30 and passed back through a first belt passageway 50 between the first transverse strut member 30 and the second transverse strut member 40. For the purposes of this application, the term belt will be used broadly to denote any strap or web-like material that is suitable to be fastened by an adjustable buckle, including but not limited to woven cloth or synthetic belts, cord, and rope. The web-like material will preferably have a degree of compressibility and flexibility, but even a solid strapping material such as molded plastic could be used advantageously with the present invention. With a more compressible and flexible strapping material, a larger angle (preferably greater than 90°) is advantageously formed between the surface of the projection into the passageway on the entrance end of the passageway and the surface from which the projection extends. The larger angle guides the webbing into the passageway and directs a large percentage of the axial force being exerted on the webbing into the passageway.

When belt 60 is properly threaded through buckle 10 as shown in FIG. 6, a force on proximal portion 62 in the direction of arrow A causes the buckle to securely tighten the belt, thus preventing adjustable distal end portion 66 from slipping back through the buckle. If the belt 60 were improperly threaded through the buckle from the bottom face 18, as shown in FIG. 7, a force on the proximal portion of belt 60 would simply cause the adjustable end to pull back through the buckle, thus failing to secure the belt.

Figure 7:
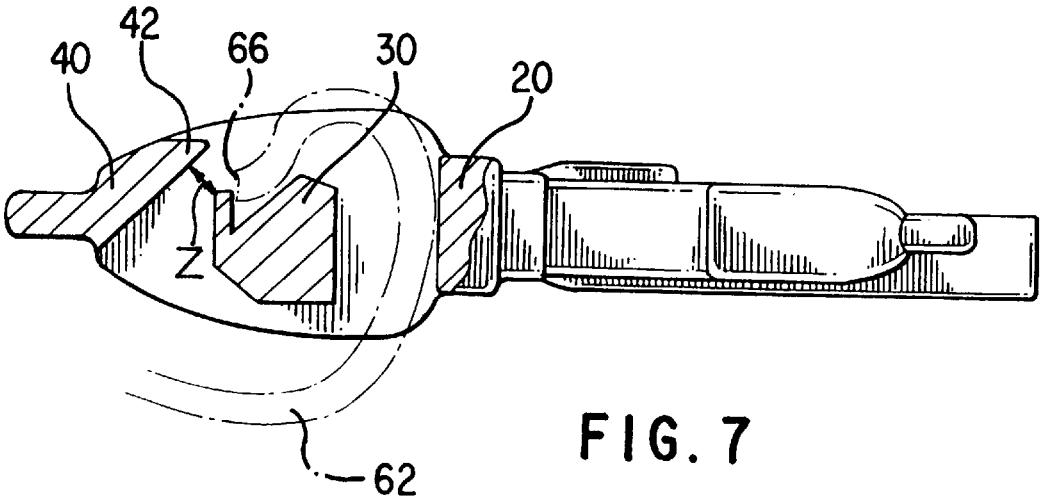
FIG. 7 is a cross-section of the buckle of FIG. 1 illustrating a belt being improperly threaded through the buckle.
Figure 1:
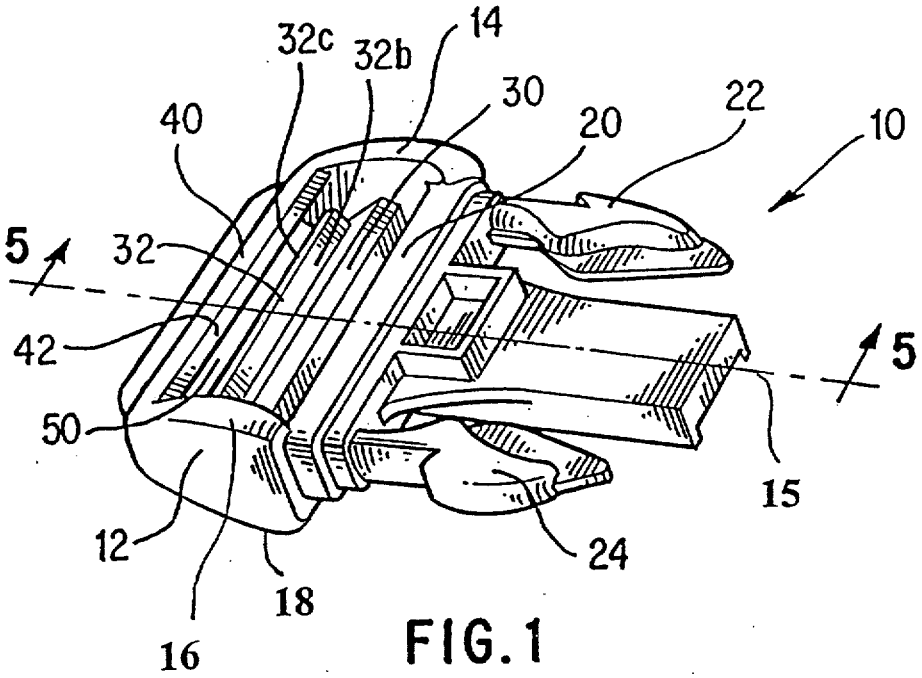
Figure 2:
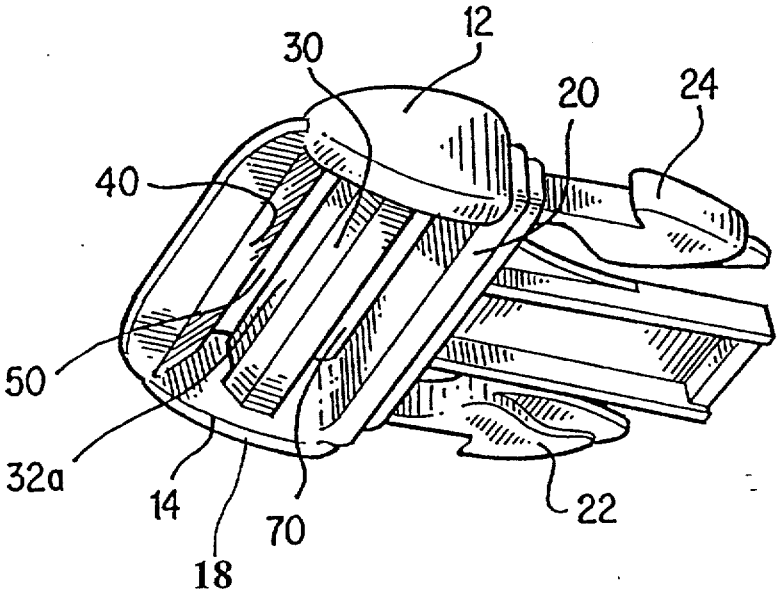
Figure 3:
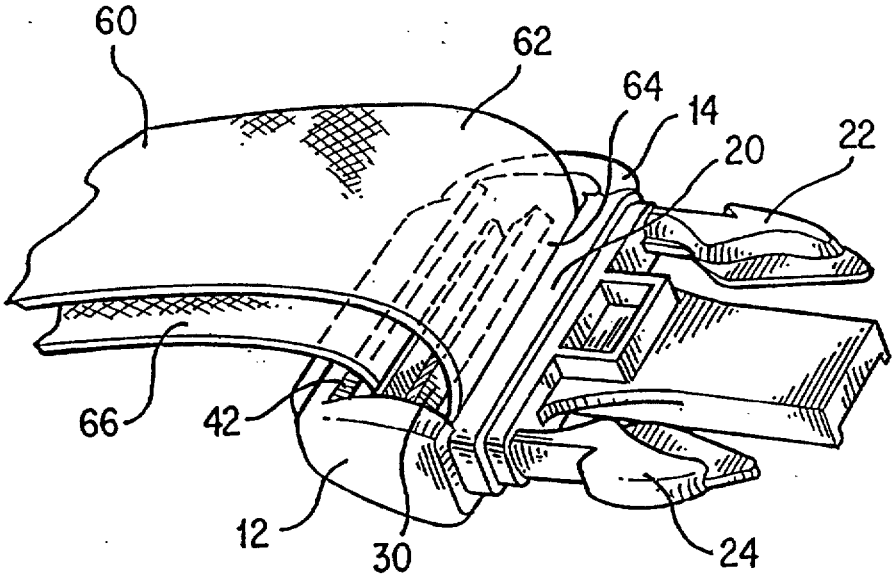
Figure 4:
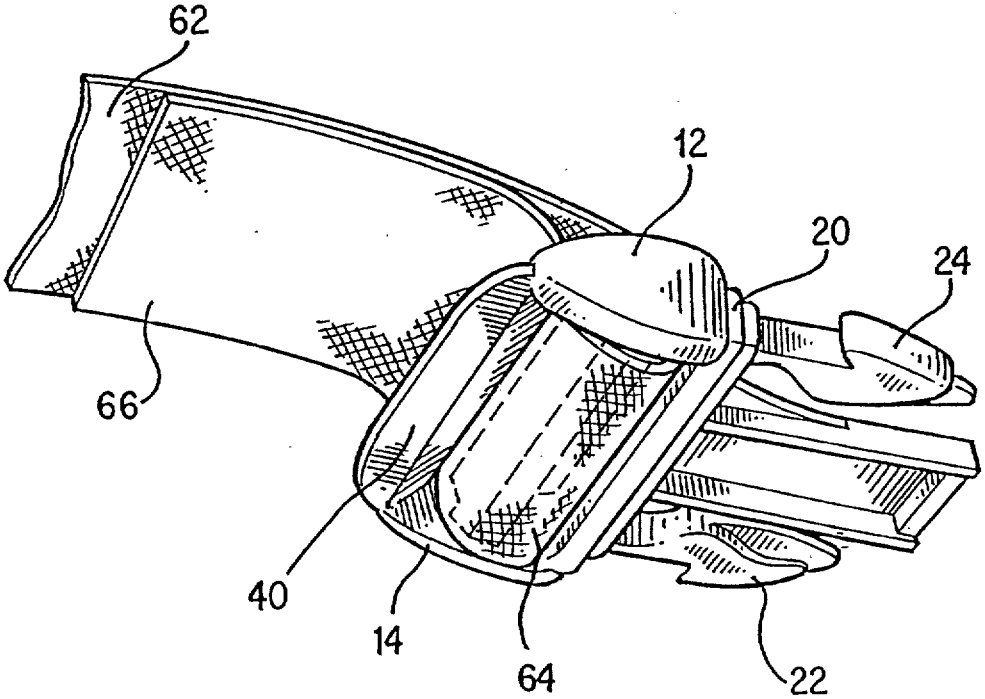
Figure 5:
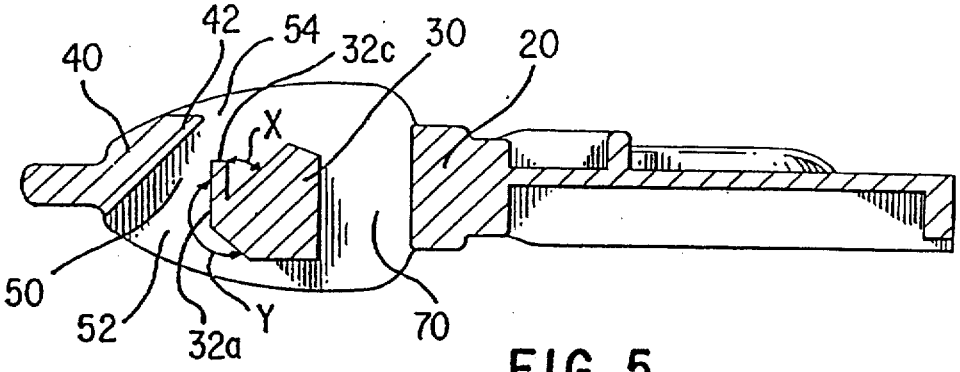
Figure 6:
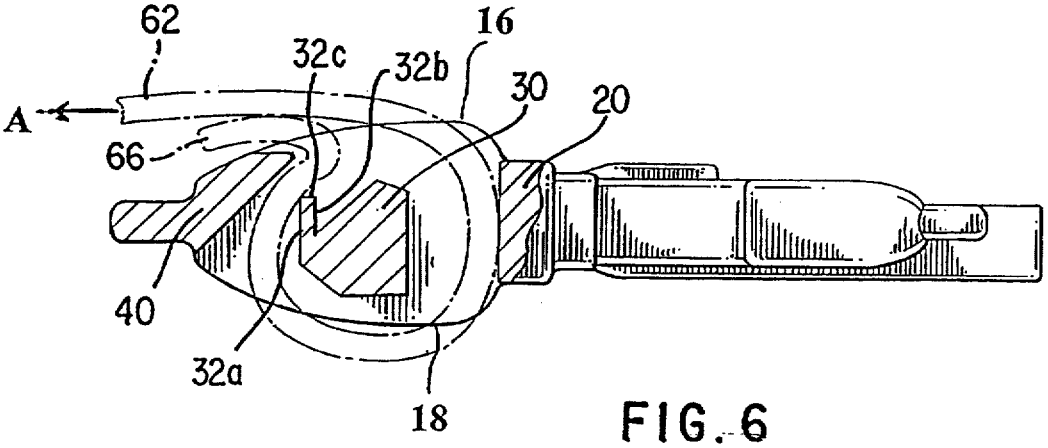
Figure 7:
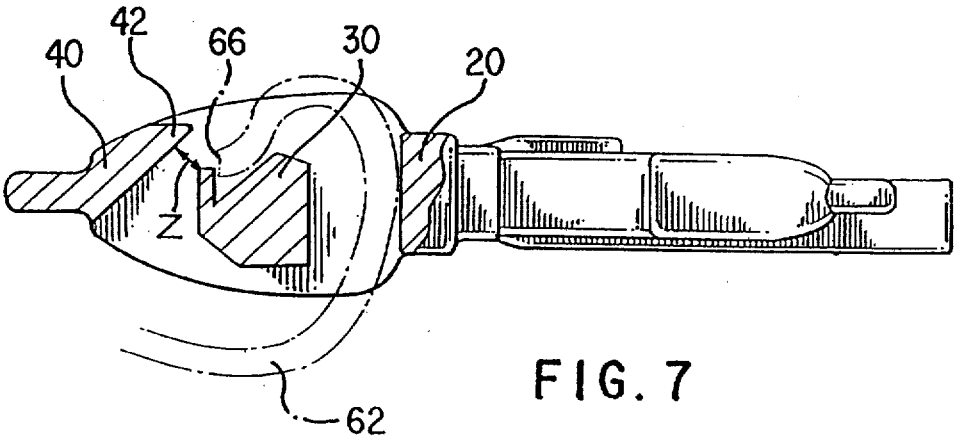

Flange 32 of the first transverse strut member 30 ensures that misthreading of the buckle is prevented or at least made more difficult than proper threading, as shown in FIG. 7. Flange 32 protrudes from first transverse strut member 30 into the first belt passageway 50 between the first transverse strut member 30 and the second transverse strut member 40. The flange 32 forms an acute angle X relative to an outer peripheral surface of the first transverse strut member 30. The flange 32 extends along substantially the entire length of the first transverse strut member 30 between the facing inner surfaces of side members 12 and 14. An artisan will recognize that alternative embodiments could include protrusions into the belt passageway that extend for a variety of distances across the width of the passageway. Rather than a single flange or protrusion, a series of finger-like protrusions or flanges that only extend part way across the passageway could be provided in accordance with the invention. Furthermore, a relatively flexible flange could be provided such that the flange will cam out of the way of webbing being inserted into the passageway from the proper entrance end, but will interfere with webbing being inserted into the passageway from the exit end.

A first surface 32*b* of flange 32 forms the acute angle X with the outer peripheral surface of the first transverse strut member 30. An opposing surface 32*a* of flange 32 forms an obtuse angle Y with the outer peripheral surface of first transverse strut member 30. Flange 32 protrudes into the first belt passageway 50 between first transverse strut member 30 and second transverse strut member 40 such that the distal end 32*c* of flange 32 is angled toward an exit 54 of the first belt passageway 50. The distance Z between the distal end 32*c* of flange 32 and the second transverse strut member 40 is predetermined such that it is just slightly larger than the thickness of belt 60.

As a result of the orientation of flange 32 relative to first belt passageway 50, when belt 60 is properly threaded through buckle 10, as shown in FIG. 6, surface 32*a* of flange 32 guides the distal end portion 66 of belt 60 through first belt passageway 50 from the entrance 52 toward the exit 54. Any attempt to thread belt 60 through the first belt passageway 50 from the exit end 54 toward the entrance 52 results in the belt interfering with the edge at distal end 32*c* of flange 32, as shown in FIG. 7, thus preventing misthreading.

In operation, the distal end portion 66 of belt 60 is threaded from upper face 16 of the buckle 10 through the second belt passageway 70 between the first transverse strut member 30 and the third transverse strut member 20. Distal end portion 66 of belt 60 is then looped around the side of first transverse strut member 30 facing bottom face 18 of the buckle 10. The distal end portion 66 is then fed upwardly through first belt passageway 50 between first transverse strut member 30 and second transverse strut member 40 from entrance 52 to exit 54 at the top face 16 of the buckle 10.

Second transverse strut member 40 is formed with an edge 42 having an acute included angle and being positioned adjacent exit end 54 of first belt passageway 50 at the upper face 16 of the buckle 10. The end portion 66 of belt 60 is bent back over edge 42 such that a force on belt 60 in the direction of arrow A secures belt 60 relative to the buckle 10 as the end portion 66 of belt 60 is trapped between edge 42 and the proximal portion 62 of the belt 60.

It will be apparent to the artisan that other embodiments are within the scope of this invention and the claims appended hereto. For example, the exact cross-sectional shape of each of the transverse strut members can vary from that shown in the figures. The passageway through the webbing fastener is defined between two opposing internal surfaces, with a protrusion from one of the surfaces extending into the passageway such that the face of the protrusion on the desired entrance end of the passageway forms a larger angle relative to the surface than the face of the protrusion on the desired exit end. The protrusion can extend across substantially the entire width of the passageway, or across less than the entire width, such as with a series of finger-like protrusions. The angle between the face of the protrusion on the desired entrance end of the passageway and the surface from which She protrusion extends can be varied as long as the result is to direct the webbing into the passageway, thus facilitating threading of the webbing in the proper direction. The angle between the face of the protrusion on the desired exit end of the passageway and the surface from which the protrusion extends can also vary, as long as it is chosen to make it more difficult to thread webbing through the passageway from the exit end toward the entrance end than from the entrance end toward the exit end. Although the buckle 10 shown in the figures is a male fastener with protruding tongues 22 and 24, the invention could be applied to a female fastener having receptacles in place of the male tongues for mating with an associated male fastener. Additionally, the webbing fastener could be formed with a first portion having an end of webbing fixedly connected thereto, and another portion for adjustably receiving either a separate piece of webbing or the opposite end of the webbing fixed at the first portion. The invention therefore is not to be limited by the specific exemplary embodiments disclosed herein but by all of the embodiments that fall within the scope of the impended claims.

What is claimed is:

1. A buckle, comprising:

a body having two side members that define an upper face and a lower face;

first and second stationary cross members disposed between and connecting facing inner surfaces of said side members, said cross members extending in substantially parallel relationship to one another and defining a strap passageway with an entrance and an exit therebetween; and said first stationary cross member including a flange that protrudes into said strap passageway at an acute angle to said first stationary cross member so as to be angled in said strap passageway toward said exit of said strap passageway.

2. The buckle according to claim 1, wherein a distance between an end of said flange and said second stationary cross member is just large enough to allow passage of a strap through said strap passageway from said entrance toward said exit.

3. The buckle according to claim 1, wherein a first surface of said flange facing said entrance of said strap passageway is obtusely disposed with respect to the outer peripheral surface of said first stationary cross member at the intersection of said first surface and said outer peripheral surface.

4. The buckle according to claim 1, wherein a second surface of said flange facing said exit of said strap passageway is acutely disposed with respect to the outer peripheral surface of said first stationary cross member at the intersection of said second surface and said outer peripheral surface.

5. The buckle according to claim 1, wherein said second stationary cross member includes an edge adjacent said exit of said strap passageway that is capable of engaging a strap passing through said strap passageway and bending over said edge such that the strap is prevented from slipping over said edge and back through said strap passageway in a direction from said exit toward said entrance.

6. The buckle according to claim 5, wherein a distance between an end of said flange and said second stationary cross member is just large enough to allow passage of a strap through said strap passageway from said entrance toward said exit.

7. The buckle according to claim 6, wherein a second surface of said flange facing said entrance of said strap passageway is obtusely disposed with respect to the outer peripheral surface of said first stationary cross member at the intersection of said first surface and said outer peripheral surface.

8. The buckle according to claim 7, wherein a second surface of said flange facing said exit of said strap passageway is acutely disposed with respect to the outer peripheral surface of said first stationary cross member at the intersection of said second surface and said outer peripheral surface.

9. The buckle according to claim 8, wherein said second stationary cross member includes an edge adjacent said exit of said strap passageway that is capable of engaging a strap passing through said strap passageway and bending over said edge such that the strap is prevented from slipping over said edge and back through said strap passageway in a direction from said second end toward said first end.

10. An adjustable belt fastener, comprising:

a body having two side members that define an upper face and a lower face;

first and second stationary strut members disposed substantially parallel to each other between and connecting facing inner surfaces of said side members, with a belt passageway being defined between said side members and said first and second strut members;

said first strut member having a flange protruding along substantially the entire length of said first strut member between said facing inner surfaces, with a first surface of said flange facing a belt entrance of said belt passageway and being disposed at an obtuse angle with respect to the outer peripheral surface of said first strut member, and a second surface of said flange opposite said first surface of said flange facing a belt exit of said belt passageway and being disposed at an acute angle with respect to the outer peripheral surface of said first strut member.

11. The adjustable belt fastener according to claim 10, wherein a distance between a distal end of said flange and said second strut member is large enough such that a belt can be passed through said belt passageway from said belt entrance toward said belt exit, but said belt interferes with said distal end if attempting to pass through said belt passageway from said belt exit toward said belt entrance.

12. The adjustable belt fastener according to claim 11, wherein said second strut member includes an edge having an acute included angle and being positioned adjacent said belt exit and parallel to said distal end of said flange.

13. The adjustable belt fastener according to claim 10, wherein said body further includes a third strut member disposed substantially parallel to said first and second strut members between and connecting said facing inner surfaces at an end of said belt fastener such that a second belt passageway is defined between said first strut, member and said third strut member.

14. An apparatus for adjusting and retaining webbing, comprising:

a body having two opposing, internal surfaces that are fixed in position relative to each other and that define a passageway therebetween;

a first one of said internal surfaces having a protrusion extending into said passageway with a first face of said protrusion facing an entrance to said passageway and a second face of said protrusion facing an exit from said passageway, said first face intersecting said first internal surface at an obtuse angle and said second face intersecting said first internal surface at an acute angle such that webbing can be inserted into said passageway more easily from said entrance than from said exit.

15. An apparatus for adjusting and retaining webbing, comprising:

a body having two opposing internal surfaces that are fixed in position relative to each other and that define a passageway therebetween;

a first one of said internal surfaces having a protrusion extending into said passageway with a first face of said protrusion facing an entrance to said passageway and a second face of said protrusion facing an exit from said passageway said first face intersecting said first internal surface at a first angle and said second face intersecting said first internal surface at a second angle such that webbing can be inserted into said passageway more easily from said entrance than from said exit, wherein said protrusion forms a flange extending into said passageway in a direction toward said exit, said flange having a distal end cantilevered into said passageway and a proximal end joined to said first internal surface such that said distal end of said flange is closer to said exit than said proximal end of said flange.

16. The apparatus according to claim 15, wherein a distance between said distal end of said flange and a second one of said two opposing, internal surfaces is slightly larger than a thickness of webbing to be inserted through said passageway.

17. The apparatus according to claim 16, wherein said second internal surface includes an edge adjacent said distal end of said flange that is capable of engaging webbing passing through said passageway from said entrance to said exit and bending over said edge such that the webbing is prevented from slipping over said edge and back through said passageway from said exit toward said entrance.

* * * * *

UNITED STATES PATENT AND TRADEMARK OFFICE

CERTIFICATE OF CORRECTION

PATENT NO. : 5,991,986
DATED : November 30, 1999
INVENTOR(S) : Canna, et. al.

It is certified that error appears in the above-identified patent and that said Letters Patent is hereby corrected as shown below:

The Title page, should be deleted and substitute therefor the attached Title page.

Drawings:

Delete Drawing sheets 1-3, and substitute therefor the Drawing Sheets 1-3 as shown on the attached pages.

Signed and Sealed this

Nineteenth Day of September, 2000

*Attest:*

Q. TODD DICKINSON

*Attesting Officer*

*Director of Patents and Trademarks*

US005991986A

United States Patent [19]

Canna et al.

[11] Patent Number: 5,991,986

[45] Date of Patent: Nov. 30, 1999

[54] BUCKLE HAVING MISTHREADING PREVENTOR

[75] Inventors: John S. Canna, Orchard Park; Kenneth VonFelten, Marietta, both of N.Y.

[73] Assignee: Mattel, Inc., El Segundo, Calif.

[21] Appl. No.: 09/143,543

[22] Filed: Aug. 28, 1998

[51] Int. Cl.[6] ..... A44B 11/00

[52] U.S. Cl. ..... 24/625; 24/197; 24/200

[58] Field of Search ..... 24/625, 634, 642, 24/615, 196, 197, 200, 194, 182, 164

[56] References Cited

U.S. PATENT DOCUMENTS

| | | | |
|---|---|---|---|
| 2,573,527 | 10/1951 | White | 24/196 |
| 4,171,555 | 10/1979 | Bakker et al. | 24/200 |
| 4,296,531 | 10/1981 | Bengtsson | 24/200 |
| 4,677,711 | 7/1987 | Anscher | 24/200 |
| 4,864,700 | 9/1989 | Kasai | 24/573 |
| 4,866,819 | 9/1989 | Kasai | 24/614 |
| 5,222,278 | 6/1993 | Ball et al. | 24/196 |
| 5,243,741 | 9/1993 | Fudaki et al. | 24/197 |
| 5,263,234 | 11/1993 | Fudaki | 24/662 |
| 5,307,542 | 5/1994 | Murai | 24/197 |
| 5,309,610 | 5/1994 | le Gal | 24/625 |
| 5,331,726 | 7/1994 | Suh | 24/625 |
| 5,526,556 | 6/1996 | Czank | 24/637 |
| 5,588,189 | 12/1996 | Gorman et al. | 24/632 |
| 5,606,783 | 3/1997 | Gillis et al. | 24/632 |
| 5,651,166 | 7/1997 | Lundstedt | 24/200 |

*Primary Examiner*—Victor N. Sakran
*Attorney, Agent, or Firm*—Morgan, Lewis & Bockius LLP

[57] ABSTRACT

A buckle is shown having two side members that define an upper face and a lower face, with at least three stationary transverse members disposed between and connecting facing inner surfaces of the side members. The three transverse members are substantially parallel to each other and define therebetween belt passageways through which a belt can be threaded and looped around a center one of the transverse members to adjustably secure the belt relative to the buckle. A flange protrudes into one of the belt passageways from substantially the entire length of the center transverse member. The flange is angled toward a first end of the belt passageway, and the distal end of the flange is spaced from the adjacent transverse member by an amount that is slightly larger than the thickness of the belt to be threaded through the belt passageway. The flange prevents threading of a belt through the belt passageway from the first end of the passageway.

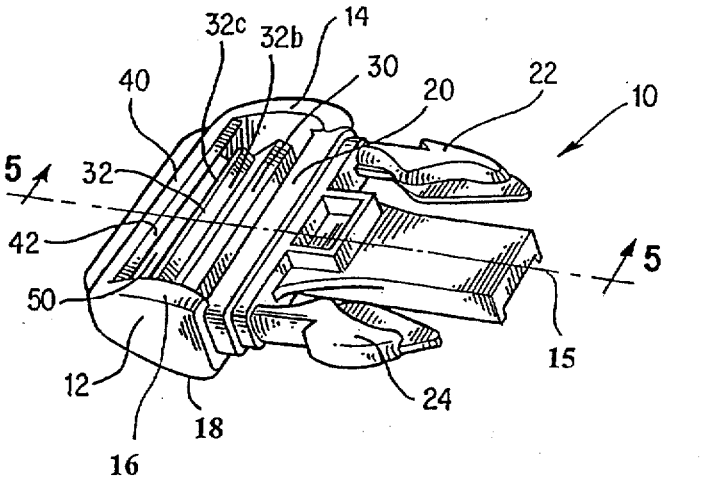

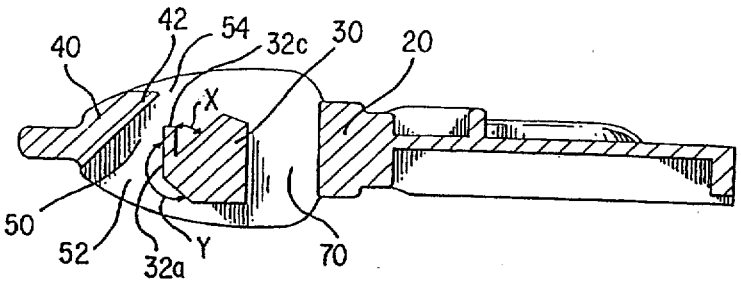

17 Claims, 3 Drawing Sheets